United States Patent [19]

Schmidt

[11] Patent Number: 4,880,148

[45] Date of Patent: Nov. 14, 1989

[54] FLUIDIZATION KIT FOR PNEUMATIC DISCHARGE OUTLET

[75] Inventor: Kenneth D. Schmidt, St. Charles, Mo.

[73] Assignee: ACF Industries, Incorporated, Earth City, Mo.

[21] Appl. No.: 161,185

[22] Filed: Feb. 26, 1988

[51] Int. Cl.[4] ..... B65G 69/06; B67D 5/58

[52] U.S. Cl. ..... 222/195; 222/189; 55/511; 406/90

[58] Field of Search ..... 222/189, 195; 55/511; 406/89–91

[56] References Cited

U.S. PATENT DOCUMENTS

| | | | |
|---|---|---|---|
| 3,305,142 | 2/1967 | Caldwell | 222/195 |
| 3,659,752 | 5/1972 | Carney, Jr. et al. | 222/505 |
| 3,693,839 | 9/1972 | Shaver et al. | 222/505 |
| 4,015,751 | 4/1977 | Rollins et al. | 406/90 |
| 4,340,402 | 7/1982 | Catron | 55/511 |

*Primary Examiner*—Kevin P. Shaver
*Assistant Examiner*—Steven M. Reiss
*Attorney, Agent, or Firm*—Polster, Polster and Lucchesi

[57] ABSTRACT

A fluidation kit for retrofit installation on a pneumatic outlet for a railway covered hopper car is disclosed. The outlet includes an outlet pan having downwardly sloping walls. The kit includes at least one air permeable fluidizing membrane on the inside face of the outlet pan wall to fluidize a powdered or pulverant lading. An externally mounted manifold assembly is attached to outside surfaces of the outlet pan for connecting the air permeable fluidizing membranes on the inside surfaces of the downwardly sloping walls of the outlet pan to a source of fluidizing air. The air permeable fluidizing membrane is supported in a peripheral extending frame member which supports the air permeable fluidizing membranes a small predetermined distance above the sloping wall surfaces to provide a plenum therebetween for diffusing fluidizing air throughout the entire extent of the air permeable fluidizing membrane. The air permeable fluidizing membrane is preferably constructed from a woven polypropylene fiber having a desired range of mesh sizes which provides a desired air permeability for fluid pressure unloading of powdered or pulverant ladings.

6 Claims, 2 Drawing Sheets

FLUIDIZATION KIT FOR PNEUMATIC DISCHARGE OUTLET

BACKGROUND OF THE INVENTION

This invention relates to a hopper discharge apparatus or outlet for the bottom of hopper cars, and more particularly, to a retrofit kit for a pneumatic outlet with the kit employing an air permeable fluidizing membrane on opposite sides of the outlet with an externally mounted common manifold assembly supplying fluidizing air to the membranes.

It is well known that over the road hopper trucks and covered hopper railway cars are provided with pneumatic or gravity discharge systems to unload various types of transported product. Where ladings including powdered or pulverant products, such as flour or the like, are unloaded, it is often advantageous that the unloading systems should fluidize the lading in order to facilitate the removal and discharge of the lading from the hopper car. This generally means that low pressure air must be introduced through air permeable membranes located in the discharge apparatus to fluidize the lading (i.e., to cause the powdered lading to flow like a liquid) thereby to permit quick and efficient unloading of ladings that tend to bridge or column during discharge. In bridging (arching) or columning (rat holing), particles of the lading interlock and resist flow because of their own weight. Some kind of assistance is needed to reduce these bridging and columning forces, and this is where fluidization, employing air permeable fluidizing members become an important part of the unloading system.

Examples of prior art designs which employ air permeable fluidizing membranes in hopper cars to facilitate unloading are shown in U.S. Patent Nos. 4,015,751, 4,280,706 and 4,568,224. Each of these patents shows an air permeable fluidizing membrane which is positioned on sloping surfaces of the pneumatic discharge outlet to allow low pressure air to be introduced into powdered lading that tend to clog the unloading outlet. While these constructions have worked quite well for their intended purpose, they have required specialized discharge outlet constructions which are not only costly to build, but expensive to maintain. There are a large number of non-fluidized pneumatic discharge outlets now being used on railroad cars, for example; however, they have not been used where fluidized lading systems are required, nor have they been capable of being converted to fluidized unloading systems.

In addition to the aforementioned prior art problems, it is also well known that the air permeable fluidizing membranes have been either fabric pads or stainless steel mesh membranes. The stainless steel fluidizing membranes are easily cleaned with soap, water or stronger chemicals without harm, and because the membrane is steel, not fabric, it will not retain undesirable moisture. Also with stainless steel, there is no danger of lint or fiber contamination. Yet, stainless steel membranes are costly, not only during the initial manufacture, but also in replacement, which is not infrequent. Sometimes, in cleaning hopper cars, workmen step on the air permeable fluidizing membranes, immediately requiring a replacement. An air permeable fluidizing membrane which could perform in the same way as the stainless steel fluidizing membranes, at a much lower cost, would be desirable.

SUMMARY OF THE INVENTION

Among the several objects and features of this invention may be noted the provision of a hopper discharge apparatus for hopper cars which provides a cost effective conversion or retrofit of standard pneumatic outlets into fluidized pneumatic outlets;

The provision of such an apparatus which includes a fluidized pneumatic outlet having air permeable fluidizing membranes and an externally mounted common manifold assembly;

The provision of such apparatus in which the externally mounted common manifold assembly does not physically interfere with the unloading of ladings through the outlet, and which is within AAR railcar clearances;

The provision of such apparatus in which the externally mounted common manifold assembly is connected by a simple and efficient construction to generally oppositely facing air permeable fluidizing membranes;

The provision of such apparatus wherein the air permeable fluidizing membranes provide all of the advantages of the best prior art constructions at a much lower initial manufacture cost as well as replacement cost; and The provision of such apparatus which does not require substantial labor or materials in converting or retrofitting standard pneumatic outlets, which can be disassembled easily from the hopper car for cleaning, which provides better or equivalent flow control for ladings such as powders, and which is otherwise well adapted for the purposes intended.

Other objects of the invention will be in part apparent and in part pointed out hereinafter.

Briefly stated, a hopper outlet is attached to the bottom of a hopper of a hopper car. The outlet includes an outlet pan having downwardly and inwardly converging side walls, and an elongated control valve means at the bottom of the outlet pan for discharging ladings carried in the hopper car. In this described environment, the improvement of the present invention comprises a fluidizing system for the outlet pan of a hopper discharge outlet and includes an air permeable fluidizing membrane which is attached to an inner surface of each of the outlet pan, and an externally mounted common manifold assembly which is attached to outer surfaces of the side walls. The common manifold assembly extends around a closed outer periphery of the control valve means and connects the air permeable membranes to a common source of pressurized air (or other fluidizing media) to fluidize ladings being discharged through the aforementioned hopper discharge outlet.

BRIEF DESCRIPTION OF PREFERRED EMBODIMENT

In the discussion that is to follow, it is to be understood that the hopper discharge apparatus and air permeable fluidizing membranes of the present invention have been primarily developed for use in railway hopper cars, where it is necessary to fluidize powdered or pulverant ladings in order to provide effective and efficient removal of the lading from the hopper cars during unloading. Furthermore, the hopper discharge apparatus and the air permeable fluidizing membranes of the present invention have been primarily developed as a fluidization retro-fit or modification kit K for existing pneumatic outlets, of which there are many in use in existing railway hopper cars. However, it will be appreciated that the hopper discharge apparatus and the air permeable fluidizing membrane of the present invention can also find potential use in over-the-road hopper trucks, as well as industrial bins, where it is also necessary to effectively and efficiently unload ladings.

Figure 1:
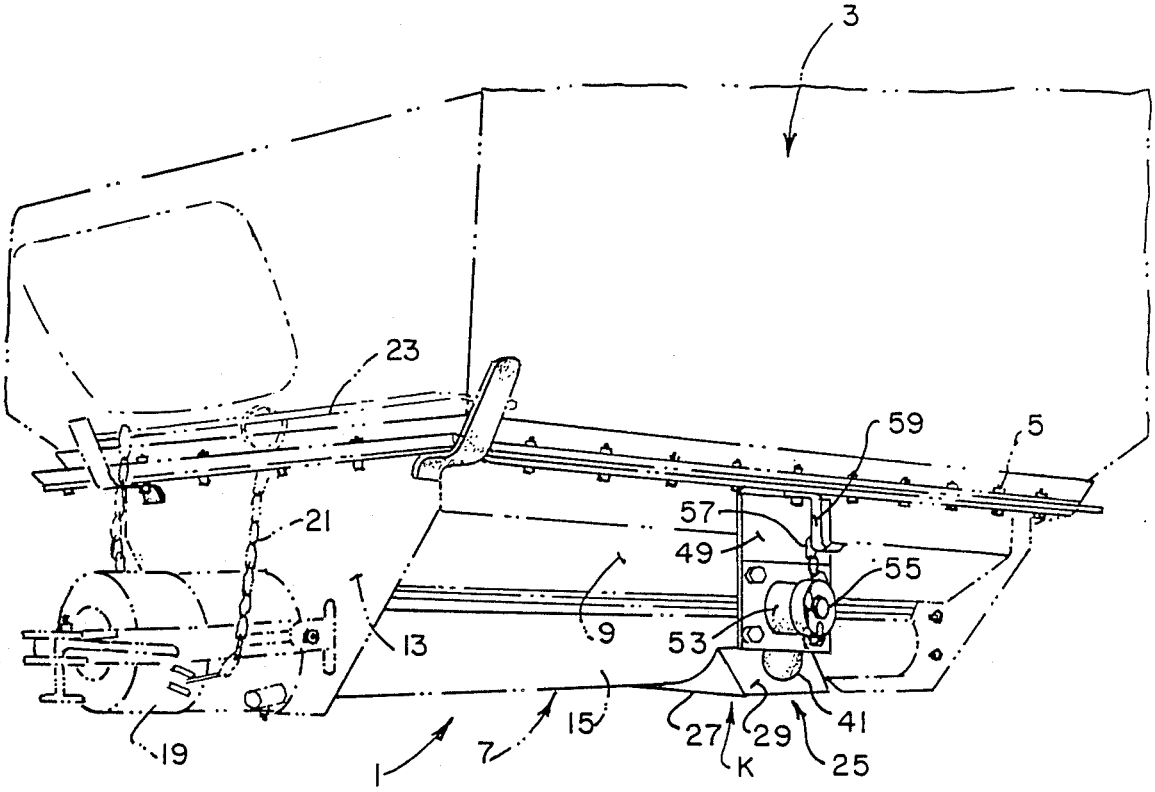
FIG. 1 is an isometric view, principally in phantom lines, showing a typical hopper discharge pneumatic outlet which is attached to the bottom of a hopper car, and also showing a portion of an externally mounted common manifold assembly, shown in solid lines, which forms a portion of a fluidizing outlet kit of the present invention.
Figure 2:
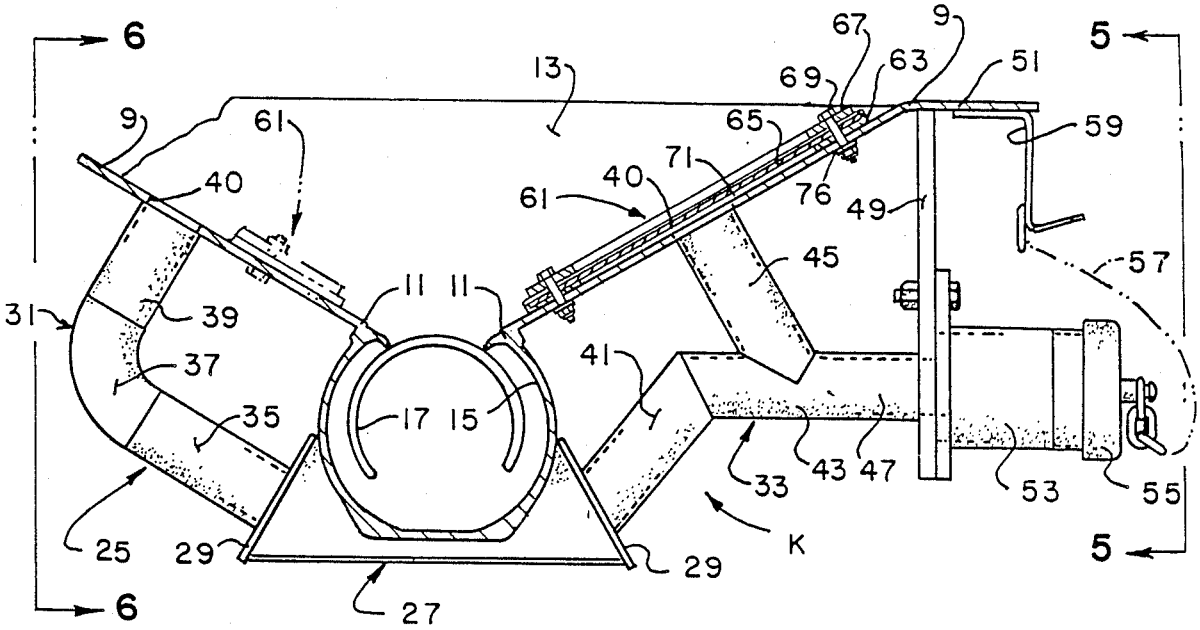
FIG. 2 is a front elevational view, partly in section, of the outlet showing the externally mounted common manifold assembly and air permeable fluidizing membranes on the inner surfaces of the outlet.
Figure 3:
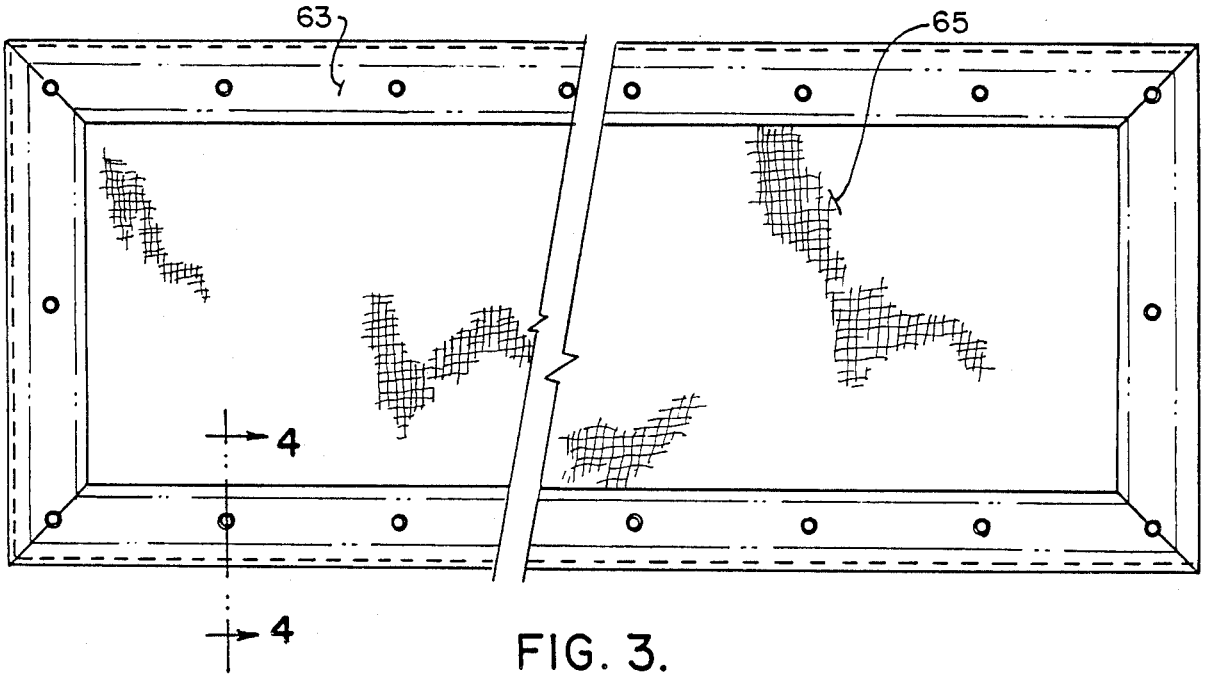
FIG. 3 is a top plan view of a frame member which supports and mounts an air permeable fluidizing membrane.

Referring now to the drawings, it will be seen that a hopper discharge apparatus or conventional pneumatic outlet 1 is attached to-the bottom of a hopper 3 of a covered hopper car (not shown) through the use of the threaded fasteners 5. The hopper discharge apparatus or outlet 1 includes an outlet pan 7 having a pair of downwardly and inwardly converging oppositely facing side walls 9 which terminate at their lower ends 11 in spaced apart relationship, as best shown in FIG. 2. Each of the downwardly and inwardly converging oppositely facing side walls 9 are integrally connected and joined (welded) to a pair of end walls 13 to define the general peripheral configuration of the outlet pan 7. An elongated upwardly opening trough or tube 15 is integrally connected to the lower portions 11 of the side walls 9 and receives a control valve 17 therein for opening and closing the trough. As will be seen, the control valve 17 is a semi-cylindrical and elongated element 17 which is rotatably mounted within the upwardly opening trough to enable the trough to be opened and closed, depending on the corresponding position of the control valve 17 relative to the open upper end of the trough, as will be understood. In addition to the aforesaid components, the typical hopper discharge apparatus further includes a cap assembly 19, at opposite ends of the trough I5, which must be removed prior to connecting the trough 15 to a source of pneumatic pressure to permit the discharge of ladings therethrough. The cap assembly 19 is attached by suitable chains 21 to the cap hanger 23 to assure that the cap assembly 19 will not be lost or misplaced during the unloading operation. Outlet 3 shown herein is a pneumatic outlet, as shown in the co-assigned U.S. Pat. Nos. 3,701,460 and 3,778,114, which are herein incorporated by reference, which outlet is commercially available from ACF Industries, Incorporated of St. Louis, Missouri under the common law trademark 5131. However, within the broader aspects of this invention, the fluidization kit K (as will be hereinafter described) may be used with most other conventionally available pneumatic outlets, such as ACF's model 5135 outlet, as shown in the co-assigned U.S. Pat. No. 4,114,785, which is also herein incorporated by reference.

When it is desired to unload ladings from a hopper car equipped with outlets 1, the cap assemblies 19 are removed from both ends of tube 15 and air is forceably drawn through the tube. The control valve 17 is the rotated to permit corresponding alignment of the opening in the control valve with the upwardly opening trough 15 thereby to permit the lading to fall into the tube 15 and to be entrained in the air flowing therethrough. Some powdered products tend to bridge and column (rat hole) during discharge. This has been overcome by the development of specially constructed fluidized pneumatic outlets which incorporate an internally mounted air plenum in association with air permeable fluidizing membranes or pads which are mounted to inner surfaces of the outlet pan side walls. Such systems incorporating internal air plenums with porous stainless steel fluidizing screens or pads have been quite effective, although costly because a specially constructed fluidized pneumatic outlet must be made. Currently in the railroad industry, most pneumatic outlets are not fluidized outlets and thus may not be effective in unloading certain powdered ladings, and may not be easily converted into a fluidized pneumatic outlet or hopper discharge apparatus. In addition, while the stainless steel fluidizing membranes of the prior art fluidized outlets have certain advantages, they are costly. During the cleaning process, when workers must enter the hopper cars to clean the cars from product contamination for subsequent use, they sometimes step on and damage this stainless steel membranes, requiring replacement. It would be very desirable to have an air permeable fluidizing membrane which works as effectively as the stainless steel fluidizing membrane, but is less costly, and which may be readily retrofitted to existing pneumatic outlets.

In accordance with the present invention, a modification or retro-fit kit K converts a standard pneumatic outlet 1 into a fluidized pneumatic outlet or discharge apparatus, and further provides an efficient and economical air permeable fluidizing membrane for use in conjunction therewith.

Kit K of the present invention for converting a standard pneumatic outlet 1 into a fluidized pneumatic outlet includes an externally mounted common manifold assembly 25. The external manifold system or assembly 25 has a saddle-shaped hollow central manifold section 27 which extends exteriorilly about the outer periphery of the trough or tube 15, as best seen in FIG. 2, along the longitudinal centerline of the car. Manifold closures 29, 29 are provided at opposite ends of the saddle-shaped central manifold section 27, and a pair of manifold arm sections 31, 33 extend from the manifold closures 29, 29 on opposite sides of the saddle-shaped central manifold section 27 for connection to outer surfaces of the side walls 9, 9. The manifold arm section 31, at the left hand side of FIG. 2, comprises a hollow air inlet tube 35 attached to the manifold closure 29, a hollow air inlet tube section 39 attached to the lower or outer surface of the side wall 9, and an intermediate hollow tube elbow section 37 which extends between the air inlet tubes 35 and 39. The upper end of tube 39 is secured (welded) to the outer face of outlet pan side wall 9 in register with a hole 40 formed in the side wall 9. The manifold arm section 33 includes a hollow air inlet tube 41 attached to the manifold closure 29, a hollow air inlet tube 45 attached to the lower or outer surface of the side wall 9, and intermediate hollow air inlet tube section 43 which is connected and joined to the free ends of the hollow air inlet tubes 41, 45, as shown on the right hand side of FIG. 2. Likewise, the upper end of tube 45 is welded to the outer face of outlet pan side wall 9 in register with a corresponding hole 40 formed in the sidewall. The inter-connecting air inlet tube 43 has its outer end 47 attached (welded) to the gusset support 49 which depends from and is attached to the lower or outer surface of the flange 51 of the outlet pan 7. Also attached to the opposite side of the gusset support 49 is an air inlet assembly 53 including a removable cap 55 having a suitable chain 57 attached to the cap hanger 59 which depends from the lower or outer surface of the flange 51 of the outlet pan 7.

When the cap 55 is removed from the air inlet adapter 53, the air inlet adapter 53 may then be connected to a suitable source pressurized air which forces air through each of the manifold arm sections 31, 33 and central manifold section 27, as a result of their being all part of a common external manifold assembly 25 which surrounds the standard pneumatic outlet or discharge apparatus 1. With the external manifold system or assembly 25, the internal air manifold and internal plenum of prior art constructions are avoided, while providing a simple and effective construction for converting standard pneumatic outlets to fluidized pneumatic outlets.

The low profile shape of central manifold 27 insures that an outlet 1 equipped with fluidizing kit K is sufficiently above the level of the rails (not shown) on which a railway car equipped with outlets 1 rides to as to be within AAR clearances.

To complete the conversion from a standard pneumatic outlet to a fluidized pneumatic outlet, air permeable fluidizing membrane assemblies 61 are provided and are mounted to an upper (inner) surfaces of the side walls 9, 9 of the outlet pan 7. Each of the air permeable fluidizing membrane assemblies 61 includes a side opening, U-shaped frame member 63 into which is mounted an air permeable fluidizing membrane 65. A clamping plate 67 is positioned above the frame member 63, and threaded fasteners 69 threadably secure the air permeable fluidizing membrane assembly 61 to a respective upper surface of each of the side walls 9, as illustrated in FIG. 2. When mounted to the side walls 9, it will be noted that the air permeable fluidizing membranes 65 are circumferentially supported by the frame 63 a short distance above the upper or inner surfaces of the side walls 9 to define a plenum chamber 71 beneath each of the air permeable fluidizing membranes 65 for diffusing air from the externally mounted common manifold assembly 25 introduced into plenum chambers 71 via openings 40 in outlet pan sidewalls 9 by manifolds 31 and 33 beneath the air permeable fluidizing membranes 65. In this regard, frame member 63 is preferably constructed from a relatively rigid plastic material which can also serve as a gasket seal when the frame member 63 is clamped tightly against a surface. Thus, the substantially continuous lower peripheral surface 73 of the frame member, except for the corresponding holes which receive the fasteners 69, provides a gasket sealing surface around the air permeable membranes 65 including the plenum area 71 to effectively and efficiently permit air to be introduced across the face of the air permeable fluidizing membrane 65 without air loss.

Figure 4:
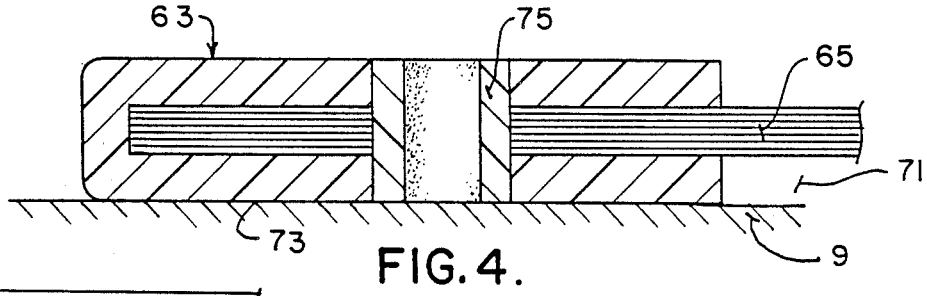
FIG. 4 is an enlarged cross sectional view taken along line 4—4 of FIG. 3 showing the manner in which air permeable fluidizing membranes are attached to and secured by the frame member.
Figure 5:
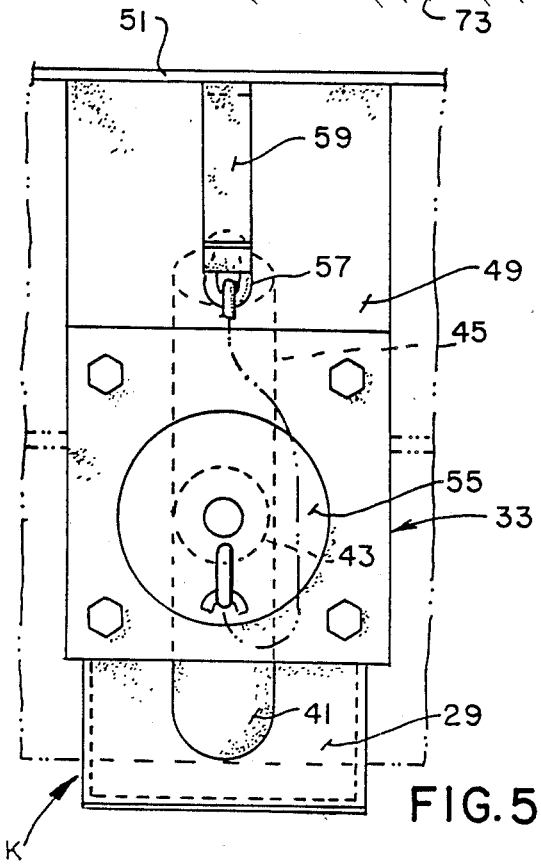
FIG. 5 is a fragmentary side elevational view taken along line 5—5 of FIG. 2 showing the externally mounted common manifold assembly from one side of the hopper car.
Figure 6:
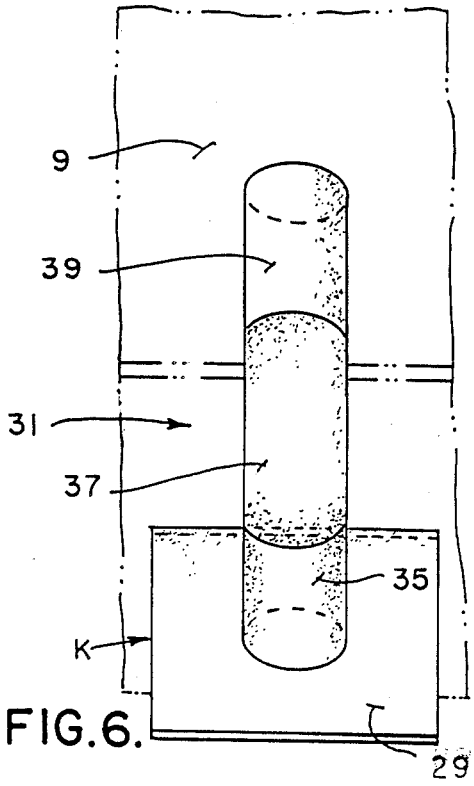
FIG. 6 is a fragmentary side elevational view taken along line 6—6 of FIG. 2 showing the externally mounted common manifold assembly from the other side of the hopper car.

The manner in which the side opening U-shaped frame member 63 support and receive the air permeable fluidizing membrane 65 is best shown in FIG. 4 of the drawings. There, it will be seen that the air permeable fluidizing membranes are received within the side opening U-shaped frame member and are secured in place by a soft plastic tube element 75 which is dimensioned and configured to be snugly received in corresponding complementary openings 76 formed in the frame member 63 and the air permeable fluidizing membrane 65.

As previously indicated, the construction of the air permeable fluidizing membranes 65 is important. Not only should the membranes 65 be chemically inert to ladings which will be transported and unloaded, but the membranes should facilitate cleaning, without retaining undesirable moisture or any danger of lint or fabric contamination. Furthermore, the permeability of the membranes should meet industry standards in fluidized pneumatic unloading, which generally have a desired permeability from about 5 to 15 cubic feet per minute (CFM) of fluidizing air to pass through 1 square foot section of the membrane having a pressure drop of about 2 inches of water across the section. In accordance with a further important feature of the present invention, the air permeable fluidizing membrane 65 are preferably, but not necessarily, constructed from a synthetic fiber, such as double glazed woven polyproplene, with a mesh size such that the membrane permeability is about 5 to 15 cubic feet per minute per square foot at 2 inches of water pressure drop. The preferred range of membrane permeability is about 5 to 10 cubic feet per minute per square foot at 2 inches of water pressure drop since it has been found that this is the most effective and efficient mesh size for the double glazed woven polyproplene fiber. An air permeable fluidizing membrane 65 constructed in the aforementioned manner achieves all of the advantages of stainless steel fluidizing membranes, but at a substantially lower cost.

In view of the above, it will be seen that the several objects of the invention are achieved and other advantageous results are obtained.

As various changes could be made in the above constructions without departing from the scope of the invention, it is intended that all matter contained in the above description are shown and the accompanied drawings shall be interpreted as illustrative and not in a limiting sense.

I claim:

1. In a hopper discharge outlet adapted to be attached to the bottom of a hopper car or the like, said outlet including an outlet pan having downwardly and inwardly converging side walls, a control valve in operative association with the lower portion of said side walls, said control valve being in communication with said outlet for the selective discharge of a lading carried in said hopper car, the improvement comprising: a fluidized outlet kit for retro-fit installation on said outlet pan, said outlet pan having an outlet tube at the bottom thereof with said control valve therein, said kit having two air permeable fluidizing membranes attached to said side walls of said outlet pan on opposite sides thereof, a space between each of said membranes and its respective side wall, said side walls each having an opening therein in communication with said space, a manifold assembly comprising a saddle-shaped central manifold section extending around and beneath said outlet tube, said outlet tube forming a wall of the manifold and said manifold having manifold arm sections extending upwardly from said central manifold section on opposite sides thereof for connection to said side walls so as to supply air under pressure to said space, said saddle-shaped central manifold being in close proximity to said outlet tube thereby to be within AAR clearances.

2. The improvement as defined in claim 1 wherein each of said air permeable membrane means is supported around its periphery in a relatively air tight relationship to said outlet pan, each of said membrane means being positioned a short distance above the inner surface of its respective side wall to define said space for diffusing air from said externally mounted common manifold assembly to said air permeable fluidized membrane means.

3. The improvement as defined in claim 2 wherein said air permeable fluidized membrane means includes a frame member having a U-shaped side opening, an air permeable membrane having its margins received in said U-shaped side opening, said frame member having a substantially continuous lower peripheral surface which serves as a gasket seal for air introduced into said space.

4. The improvement as defined in claim 3 wherein said air permeable membrane is constructed from a suitable woven fiber with material having a mesh size such that the its air permeability ranges between about five to fifteen cubic feet of air per minute per square foot at two inches of water pressure drop.

5. The improvement as defined in claim 4 wherein the membrane is a double glazed woven polyproplene fabric having an air permeability ranging between about five to ten cubic feet per minute per square foot at two inches of water pressure drop.

6. The improvement as defined in claim 1 wherein one of the manifold arm sections is adapted to be connected to a source of pressurized air for introducing air throughout the manifold assembly.

* * * * *